US009896242B2

(12) United States Patent
Olson

(10) Patent No.: US 9,896,242 B2
(45) Date of Patent: Feb. 20, 2018

(54) MULTIPURPOSE DISPENSER FOR SPREADABLE WALL REPAIR COMPOUND

(71) Applicant: 3M INNOVATIVE PROPERTIES COMPANY, St. Paul, MN (US)

(72) Inventor: Christopher R. Olson, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/114,863

(22) PCT Filed: Jan. 30, 2015

(86) PCT No.: PCT/US2015/013775
§ 371 (c)(1),
(2) Date: Jul. 28, 2016

(87) PCT Pub. No.: WO2015/119853
PCT Pub. Date: Aug. 13, 2015

(65) Prior Publication Data

US 2017/0233146 A1 Aug. 17, 2017

Related U.S. Application Data

(60) Provisional application No. 61/937,875, filed on Feb. 10, 2014.

(51) Int. Cl.
*B05C 11/00* (2006.01)
*B65D 35/36* (2006.01)
*B65D 51/28* (2006.01)

(52) U.S. Cl.
CPC ..... *B65D 35/36* (2013.01); *B65D 51/28* (2013.01)

(58) Field of Classification Search
CPC ..... B65D 35/36; B65D 51/28
(Continued)

(56) References Cited

U.S. PATENT DOCUMENTS 1,598,811 A 9/1926 Ferrin
2,770,826 A 11/1956 Curfman
(Continued)

FOREIGN PATENT DOCUMENTS

DE 3519321 12/1986
GB 124343 3/1919
(Continued)

OTHER PUBLICATIONS

PCT International Search Report from PCT/US2015/013775 dated Apr. 23, 2015, 2 pages.
(Continued)

*Primary Examiner* — Jennifer C Chiang
(74) *Attorney, Agent, or Firm* — Kevin Weber

(57) ABSTRACT

A container for dispensing a flowable material includes a body member having a neck portion containing an opening for dispensing the flowable material, a collapsible mid portion adjacent the neck portion, and a non-collapsible tail portion adjacent the mid portion that serves as a blade for smoothing the flowable material after the flowable material has been dispensed from the container. Also disclosed is such a container having a cap and an abrasive assembly including a lid and an abrasive element for sanding the hardened material.

30 Claims, 7 Drawing Sheets

(58) Field of Classification Search
USPC ..... 401/183, 266
See application file for complete search history.

(56) References Cited

U.S. PATENT DOCUMENTS

| | | | |
|---|---|---|---|
| 3,070,823 | A | 1/1963 | Heinig |
| 3,121,906 | A | 2/1964 | Hulsh |
| 4,674,903 | A | 6/1987 | Chen |
| 4,955,747 | A | 9/1990 | Tarver |
| 4,964,538 | A | 10/1990 | Nimmey et al. |
| 5,106,221 | A | 4/1992 | Diot et al. |
| D326,019 | S | 5/1992 | Spangler et al. |
| D338,298 | S | 8/1993 | Grim, Sr. |
| D356,259 | S | 3/1995 | Hoyt |
| 5,577,851 | A | 11/1996 | Koptis |
| 5,638,990 | A | 6/1997 | Kastberg |
| 5,788,104 | A | 8/1998 | Hoyt |
| 5,800,144 | A | 9/1998 | Glenn et al. |
| 5,803,639 | A | 9/1998 | Gusakov et al. |
| 6,767,151 | B1 | 7/2004 | Owens |
| 7,255,249 | B2 | 8/2007 | Whitney |
| 7,744,299 | B1 | 6/2010 | Greer, Jr. et al. |
| 8,839,538 | B2 * | 9/2014 | Franko, Sr. ..... G06K 19/07758 222/93 |
| 2005/0012325 | A1 | 1/2005 | Franko, Sr. et al. |
| 2005/0217034 | A1 | 10/2005 | Miller et al. |
| 2006/0285913 | A1 | 12/2006 | Koptis |
| 2009/0241457 | A1 | 10/2009 | Brunelle |
| 2016/0122088 | A1 | 5/2016 | Jamison |

FOREIGN PATENT DOCUMENTS

| | | |
|---|---|---|
| WO | WO 2005/039991 | 5/2005 |
| WO | WO 2006/089824 | 8/2006 |

OTHER PUBLICATIONS

General Electric Caulk-it ad campaign, from web page: https://www.behance.net/gallery/12039087/General-Electric-Caulk-it-ad-campaign Retrieved on Jun. 28, 2016, 6 pages.

* cited by examiner

MULTIPURPOSE DISPENSER FOR SPREADABLE WALL REPAIR COMPOUND

BACKGROUND

The present invention relates generally to containers for dispensing flowable materials and, more particularly, to a flexible tube-like container that can be manually squeezed to dispense the flowable material from the tube.

Wall repair compounds, such as spackle (also referred to as spackling compound), are commonly used to repair cracks, holes, or other imperfections in a wall caused by, for example, nails, drilling, or impact before the wall is painted or otherwise finished. Repairing a damaged wall surface using spackle typically involves applying one or more coats of spackling compound to the wall surface using a tool such as a putty knife. Spackling compound is typically sold in tubs having openings that are large enough for the putty knife to be dipped into the tub and coated with spackling compound. The putty knife can then be used to apply the spackling compound to the wall surface and spread it evenly on the wall surface. After the spackling compound has dried and hardened, it can be sanded smooth using a conventional abrasive such as sandpaper or a sanding sponge.

Tube dispensers are known in the prior art. U.S. Pat. No. 5,577,851 (Koptis) for example, discloses a tube dispenser, sponge applicator and cover assembly including a tube dispenser having a main body portion, an upper neck portion extending from the main body at an upper end and an upper circumferential portion at the upper end of the main body portion adjacent to the neck portion. U.S. Pat. No. 7,744,299 discloses a dispensing system for patching an untextured portion of a destination surface to substantially match an existing structure of an existing sprayed on texture pattern on the destination surface surrounding the untextured portion. The dispensing system comprises a container, a sponge member, and a scraper member.

SUMMARY

The methods and dispensers of the prior art suffer from a number of deficiencies. The conventional method of applying wall repair compound, such as spackling compound, requires the user to have three separate items to complete the task, namely, the container of spackling compound, a putty knife, and an abrasive. The need exists for a multipurpose container that can be used to store, dispense, spread and sand a wall repair compound. The prior art dispensers fail to overcome these deficiencies. It would be desirable to provide a multipurpose container that overcomes these deficiencies.

The present disclosure provides a multipurpose container for dispensing a flowable wall repair material, such as spackle. The container includes a body member having a neck portion containing an opening for dispensing the flowable material, a collapsible mid portion adjacent the neck portion, and a non-collapsible tail portion adjacent the mid portion that serves as a blade for smoothing the flowable material after the flowable material has been dispensed from the container.

In more specific embodiments, the container may include a tapered shoulder portion adjacent the neck portion, the body member may be a flexible tube flattened at one end, the unflattened portion of the tube may include tapered side walls that form a portion of the mid portion, the flattened end may form the tail portion of the body member, the mid portion and tail portion may have a unitary one-piece construction, the mid portion may be an elongated hollow tube having a wall defining a chamber for receiving the flowable material, the tail portion may be generally flat and extend from the mid portion, the tail portion may be formed by opposed portions of the wall brought into contact with each other, the body member may be formed of high or low density polyethylene, the wall may have a thickness of at least about 0.2 millimeter and a thickness of no greater than about 5 millimeters, the tail portion may have a length of at least about 8 millimeters and a length of no greater than about 60 millimeters, the tail portion may have opposed major surfaces including elongated recessed regions, the tail portion may include reinforcing rib structures, the tail portion may include generally planar opposed major surfaces, the tail portion may be formed by laminating the wall to itself, the region between the mid portion and the tail portion may form a boundary that is arcuate, the tail portion may include a linear terminal edge that forms an edge for smoothing the flowable material after it has been dispensed from the container, the container may include a cap member configured to removably connect with the neck portion and thereby selectively close the opening in the neck portion, the cap member may include a first end containing a threaded connection for threadably securing the cap member to the neck portion, the cap member may include a second end containing a recessed storage compartment, the container may include an abrasive assembly removably secured to the cap member, the abrasive assembly may include a lid (or top) and an abrasive element connected with the lid, the lid may include a base wall having opposed first and second major surfaces wherein the abrasive element may be provided on the first major surface, the lid may include a handle portion arranged opposite the abrasive element, the lid may include a first annular side wall extending in a first direction away from the base wall first major surface, thereby defining a first cavity, the lid may include a second annular side wall extending in a second direction away from the base wall second major surface, thereby defining a second cavity, the abrasive element may be arranged in the first cavity, the first annular side wall may be configured to slidably releasably engage with a mating cavity provided in the cap member, the abrasive may be arranged in the first cavity, the abrasive element may include a foam substrate having first and second opposed major surfaces, wherein the first major surface may be adhesive for bonding the abrasive element to the lid and the second major surface may be abrasive, the flowable material may have a putty-like consistency, and/or the opening in the neck may be circular and have a diameter of at least about 1 millimeter and no greater than about 4 millimeters.

Advantages of certain embodiments of the container include that it provides a body member that allows a user to readily dispense a flowable material from the container by squeezing the body member while also providing a tail portion that is large enough and stiff enough to serve as a putty knife for spreading the flowable material after is has been dispensed from the container. In other embodiments, the container includes a cap and abrasive assembly that allow a user to sand the flowable material after is has been allowed to dry and harden. In a specific embodiment, the container provides a multipurpose all-in-one dispenser system that provides a user with all of the items needed to complete a wall repair project. In particular, the container contains wall repair compound, such as spackling, that can be readily dispensed by squeezing the container, the container includes a unitary tail portion that serves as a putty knife for spreading the wall repair compound after it has been dispensed from the container, and the container includes a cap member and an abrasive assembly, whereby the abrasive assembly can be connected with the cap member to conveniently store the abrasive assembly, and the abrasive assembly can be separated from the cap member, whereby the user can sand the wall repair compound to a smooth surface after the wall repair compound has dried and hardened.

BRIEF DESCRIPTION OF THE DRAWINGS

The present disclosure will be further described with reference to the accompanying drawings, in which.

DETAILED DESCRIPTION

Figure 1A:
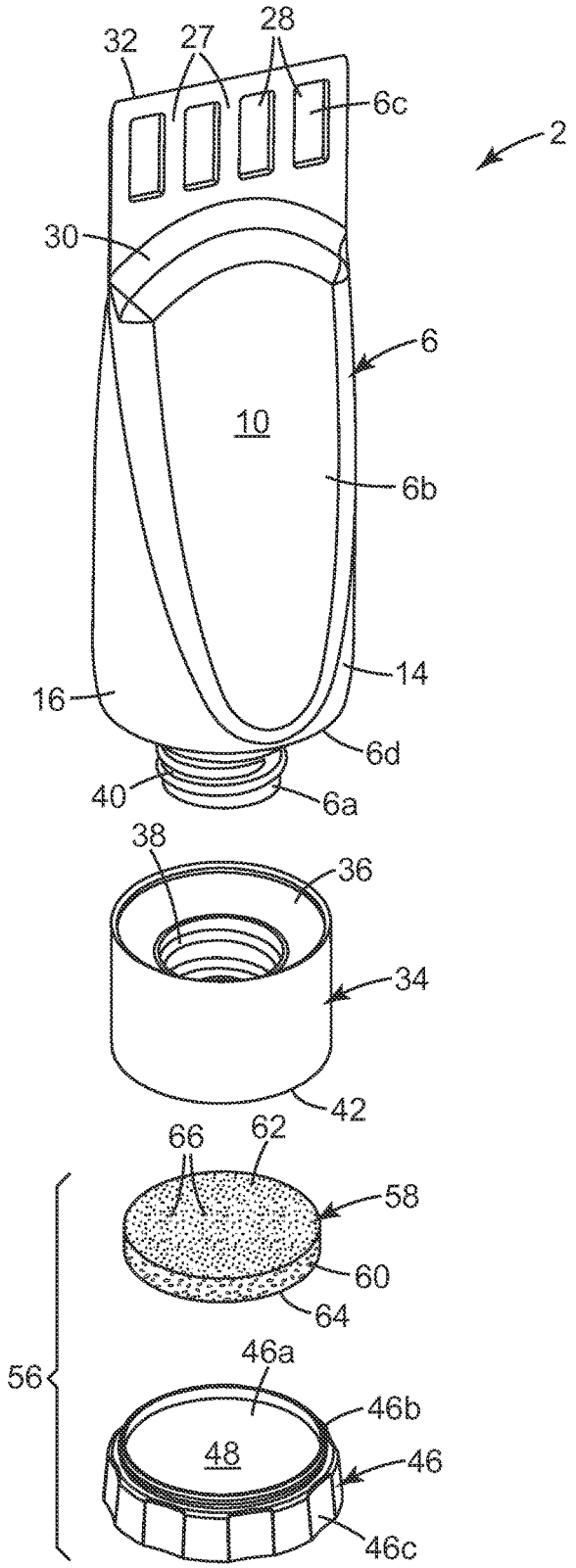
FIG. 1*a* is an exploded perspective view of a container according to the present disclosure.
Figure 1B:
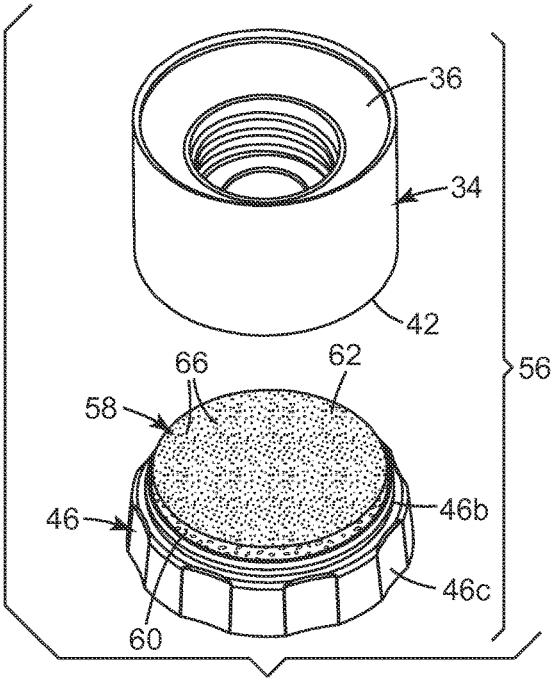
FIG. 1*b* is a partially exploded perspective view of the cap and abrasive assembly taken from a first vantage point.
Figure 1C:
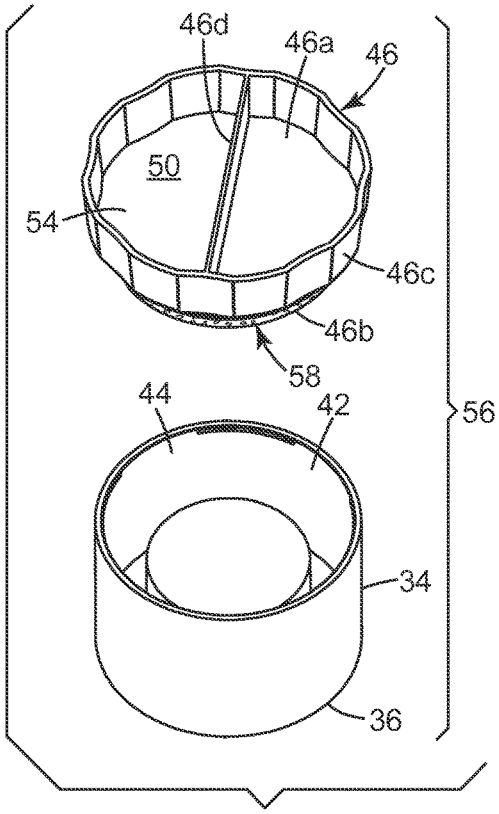
FIG. 1*c* is a partially exploded perspective view of the cap and abrasive assembly taken from a second vantage point.
Figure 2:
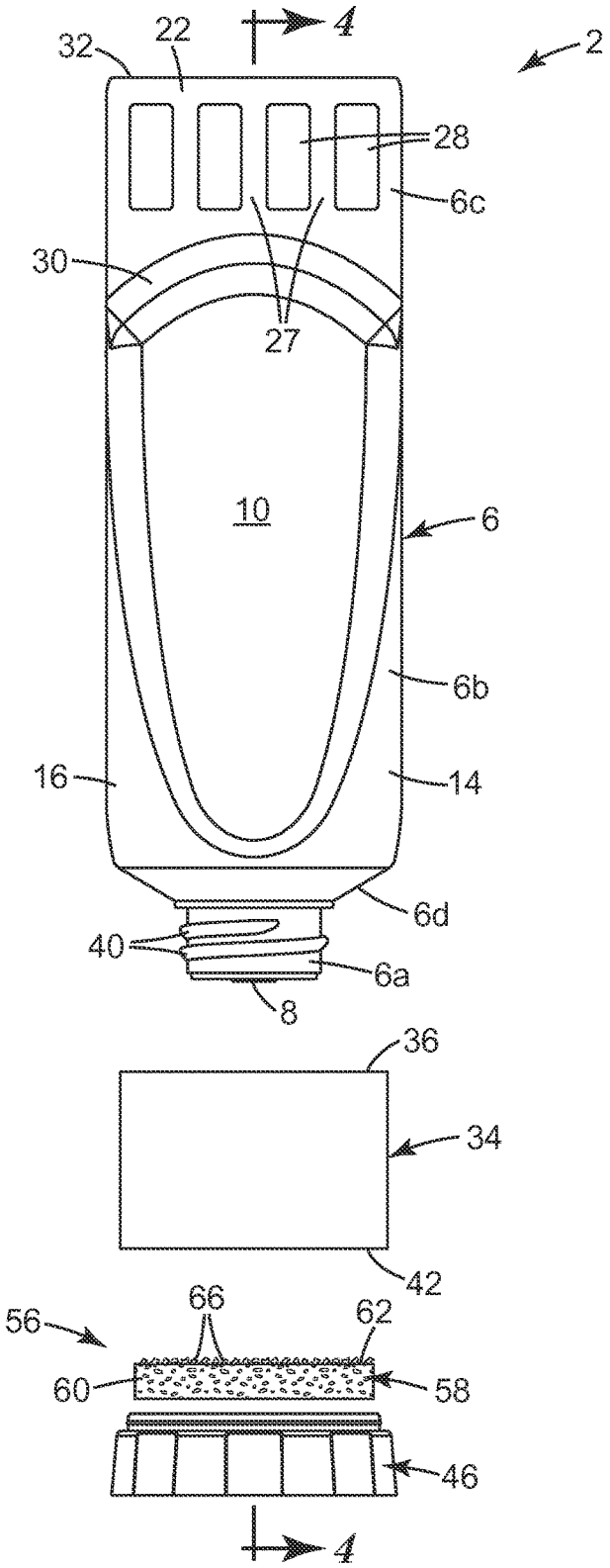
FIG. 2 is an exploded front view of a container according to the present disclosure.
Figure 3:
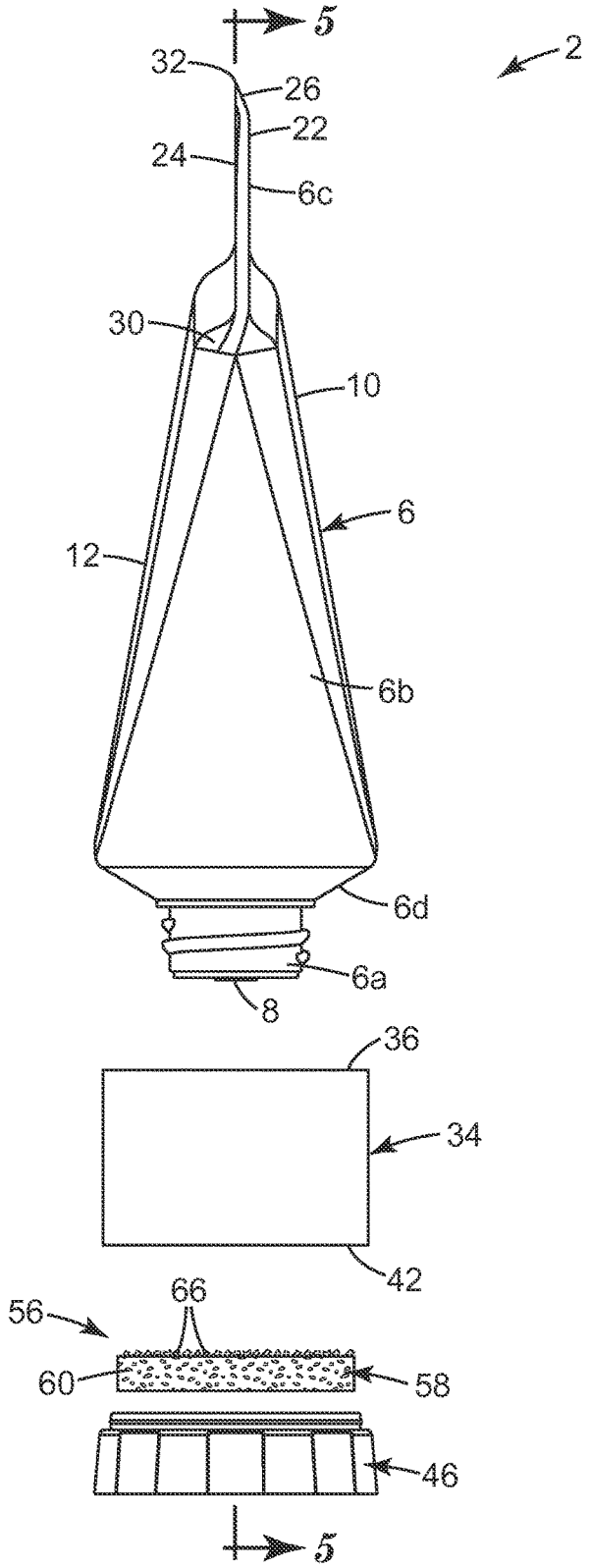
FIG. 3 is an exploded side view of a container according to the present disclosure.
Figure 4:
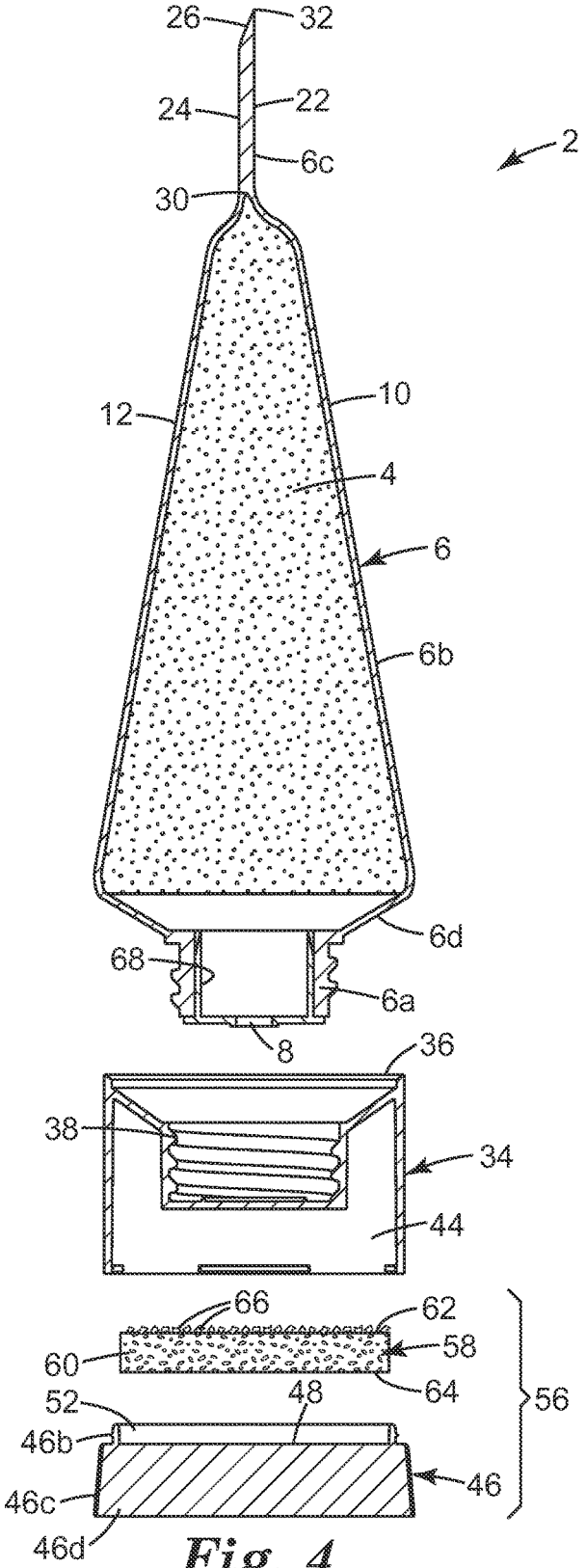
FIG. 4 is an exploded cross-sectional view taken along line 4-4 of FIG. 2.
Figure 5:
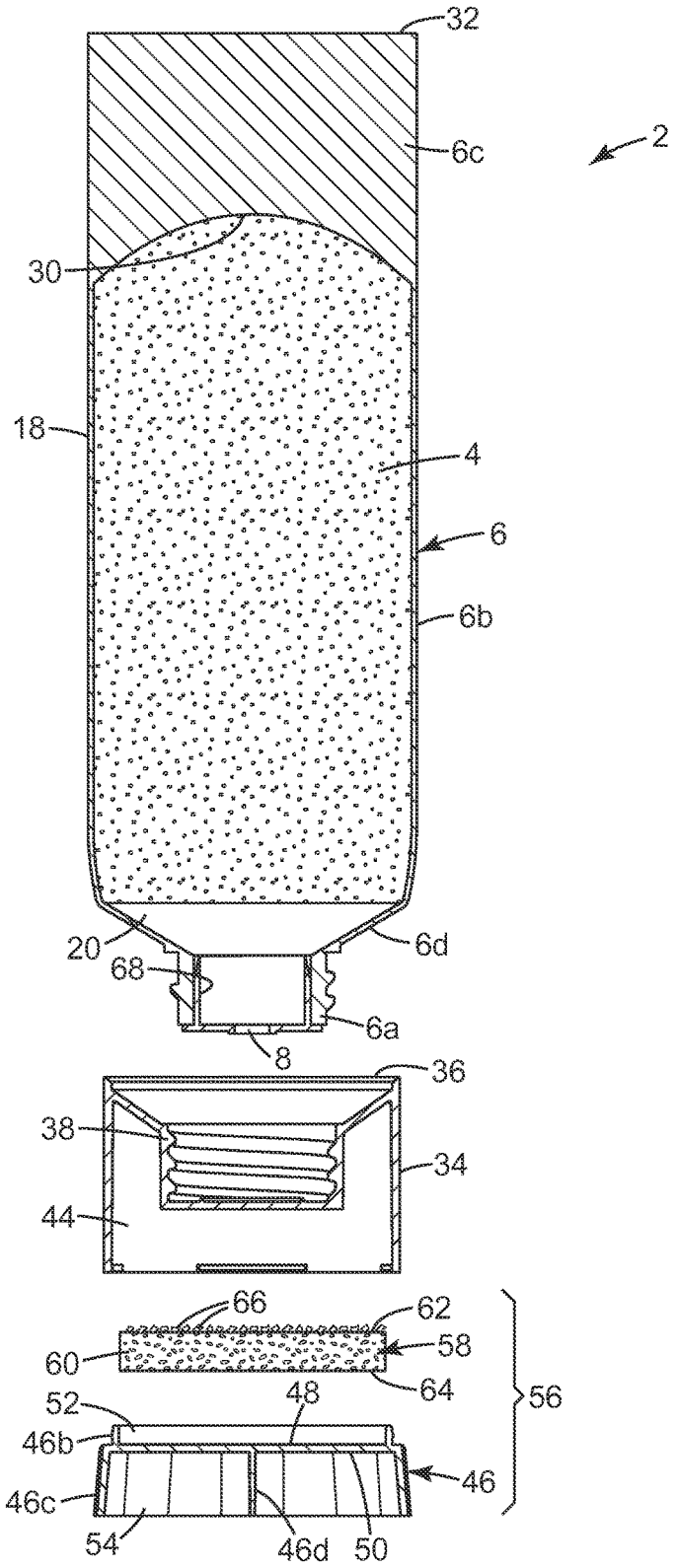
FIG. 5 is an exploded cross-sectional view taken along line 5-5 of FIG. 3.

Referring now to the drawings, wherein like reference numerals refer to like or corresponding parts throughout the several views, FIGS. 1-5, show a container 2 for dispensing a flowable material 4 which may be, for example, a wall repair compound, such as spackling compound or the like. The container 2 includes a body member 6 having a neck portion 6*a* containing an exit orifice or opening 8 for dispensing the flowable material, a collapsible mid portion 6*b* adjacent the neck portion 6*a*, and a flexible but generally stiff non-collapsible tail portion 6*c* adjacent the mid portion 6*b* that serves as a blade for smoothing the flowable material 4 after the flowable material 4 has been dispensed from the container 2. When sold, the container 2 may include an optional moisture barrier (not shown), such an adhesive tab, that initially covers the opening 8, or the container may be initially closed, whereby the opening 8 may be formed by an end user by piercing the neck portion 6*a* with a sharp object, such as a knife, nail, or screw driver.

In the illustrated embodiment, the body member 6 includes a shoulder portion 6*d* that flairs outwardly and extends from the neck portion 6*a* to the mid portion 6*b*. The body member 6 generally has the shape of a hollow tube that has been flattened at one end, and the flattened end forms the tail portion 6*c*. As such, the shoulder portion 6*d* of the body member 6, as well as the region of the body member 6 adjacent the shoulder portion 6*d*, has a generally circular cross-section, and the body member 6 is tapered and becomes progressively narrower in the direction away from the neck portion 6*a* as shown most clearly in FIGS. 3 and 4. More specifically, the body member 6 has opposed generally flat front and back surfaces 10, 12 that taper inwardly toward each other as they get closer to the tail portion 6*c*, and curved side surfaces 14, 16 that remain generally parallel along the length of the body member 6.

The tapered portion of the tube forms the mid portion 6*b* of the body member 6. The body member 6 is an elongated hollow tube having a wall 18 that defines an interior chamber 20 for receiving the flowable material 4. In certain embodiments, the interior chamber 20 may have a volume of, for example, at least about 0.5 fluid ounces, at least about 1 fluid ounce, or at least about 1.5 fluid ounces, and a volume of no greater than 3 fluid ounces, no greater than about 4.5 fluid ounces, or no greater than about 6 fluid ounces.

The flattened end of the body member 6 forms the tail portion 6*c*. More particularly, the tail portion 6*c* is a generally flat portion that extends from the mid portion 6*b* where opposed portions of the wall 18 generally corresponding to the side surfaces 10, 12 are brought into contact. That is, the tail portion 6*c* is the region of the body member 6 where opposed inner surfaces of the wall 18 are contiguous.

In some embodiments, the mid portion 6*b* and tail portion 6*c* have a unitary or one-piece construction. The body member 6 may be constructed of any suitable material, such as a soft or resilient synthetic plastic material, paper, metal, or the like. To maximize the shelf life of the flowable material 4, it is generally desirable for the body member 6 to be formed of a material that is substantially impermeable to air and moisture. Particularly suitable materials include low density polyethylene, high density polyethylene, or a laminate structure comprising layers of polyethylene, aluminum foil, paper, and polyethylene. The body member 6 may be formed using conventional techniques such as, for example, extrusion blow molding or injection blow molding. The tail portion 6*c* may be formed by, for example, pressing the wall 18 together and laminating the wall 18 to itself using heat and pressure, or by compression molding. The tail portion 6*c* may be formed simultaneously during the formation of the body member 6, or the tail portion 6*c* may be formed in a post processing step. As explained more fully below, the tail portion 6*c* is somewhat flexible yet stiff enough to be used as a putty knife to spread the flowable material 4.

The body member 6 is designed to allow the flowable material 4 to be readily dispensed from the container 2 by manually squeezing the mid portion 6*b* of the body member. A number of factors, such as the viscosity of the flowable material 4, the size of the opening 8, the type of material used to fabricate the body member 6, and the thickness of the wall 18, will impact the ability to achieve this. In the illustrated embodiment, the container 2 includes a plug 68 arranged in the neck portion 6*a* of the body member 6, whereby the plug 68 contains the opening 8. By providing a separate plug 68 that contains the opening 8 rather than relying on the opening in the neck portion 6*a*, the size and shape of the opening 8 can be easily changed without changing the design of the body member 6 by simply inserting plugs with different sized and shaped openings into the neck portion 6*a*.

In some embodiments, the flowable material 4 has a putty-like consistency that does not readily flow on its own, but will deform or flow when a manual squeezing force is applied to it. Thus, depending on the particular flowable material 4 in the container 2, and depending on the type of material used to form the body member 6, the opening 8 may be circular and have a diameter of at least about 0.5 millimeters, at least about 1 millimeter, or at least about 2 millimeter, and a diameter of no greater than about 4 millimeters, no greater than about 5 millimeters, no greater than about 7 millimeters, or no greater than about 9 millimeters. In addition, the wall 18 may have a thickness of at least about 0.2 millimeters, at least about 0.3 millimeters, or at least about 0.5 millimeter, and a thickness of no greater than about 1.5 millimeters, no greater than about 3 millimeters, or no greater than about 5 millimeters.

In some embodiments, the body member 6 is designed to allow the tail portion 6*c* to be used as a putty knife to spread and smooth the flowable material 4 after it has been dispensed from the container 2. As such, the tail portion 6*c* has a size and stiffness that to allow it to be used as a putty knife. Designing the tail portion 6*c* in this manner, however, runs counter to designing the mid portion 6*b* in a manner that allows the flowable material 4 to be dispensed from the container 2 by squeezing the mid portion 6*b*. This is particularly true in the embodiment where the body member 6 has a unitary construction and the mid portion 6*b* and tail portion 6*c* are formed from the same material. Surprisingly, it was found that by carefully balancing a number of parameters, the tail portion 6*c* could be designed to be stiff enough to be used as a putty knife while also allowing the mid portion 6*b* to be flexible enough for the flowable material 4 to be dispensed by squeezing. The parameters include the size of the opening 8, the type of material used to form the body member 6, the thickness of the wall 18, and the viscosity of the flowable material 4 to be dispensed from the container.

In one embodiment, the tail portion 6*c* may have a length of, for example, at least about 8 millimeters, at least about 15 millimeters, or at least about 25 millimeters, and a length of no greater than about 40 millimeters, no greater than about 50 millimeters, or no greater than about 60 millimeters. The tail portion 6*c* may have a thickness of at least about 0.3 millimeters, at least about 0.5 millimeters, or at least about 0.7 millimeter, and a thickness of no greater than about 1.5 millimeter, no greater than about 2 millimeters, no greater than about 3 millimeters, or no greater than about 4 millimeters.

The tail portion 6*c* includes generally planar opposed major surfaces 22, 24. Optional stiffening features may be incorporated into the tail portion 6*c* to enhance the stiffness of the tail portion 6*c*. In some embodiments, the tail portion 6*c* includes elongated recessed stiffening regions 28. The recessed regions 28 are elongated valleys that extend in a direction parallel to the longitudinal axis of the body member 6. In some embodiments, the tail portion 6*c* also includes stiffening ribs 27. It will be recognized that other optional stiffening structures, materials or features may be incorporated into the tail portion 6*c* to further increase its stiffness including, for example, providing raised regions, providing additional layers of material to increase the overall thickness of the tail portion 6*c*, or incorporating stiffer material into the tail portion 6*c* by, for example, bonding strips of rigid material to the opposed major surfaces 22, 24 of the tail portion 6*c*.

In the illustrated embodiment, the interface between the mid portion 6*b* and the tail portion 6*c* forms an arcuate boundary 30 or, more particularly, convex from the perspective of the tail portion 6*c*. The particular shape of the boundary 30 is not critical so long as it provides the desired function. As such, the boundary 30 may be, for example, linear, concave, wavy, or an inverted V shape. Surprisingly, it was found that the shape of the boundary 30 could be used to adjust the stiffness of the tail portion 6*c*. That is, certain shapes were found to impart differing degrees of stiffness to the tail portion 6*c*. The tail portion 6*c* includes a linear edge 32 that forms a blade for smoothing the flowable material 4 after it has been dispensed from the container 2. As shown most clearly in FIGS. 3 and 4, the terminal end 26 of the tail portion 6*c* tapers to a point to facilitate the use of the edge 32 as a putty knife.

In the illustrated embodiment, the container 2 includes a cap member 34 configured to removably connect with the neck portion 6*c*, and thereby selectively close the opening 8 in the neck portion 6*c*. More particularly, the cap member 34 includes a first end 36 having inner threads 38 that cooperate with outer threads 40 provided on the neck portion 6*c* for threadably securing the cap member 34 to the neck portion 6*c*. The cap member 34 further includes a second end 42 containing a recessed storage compartment 44.

Figure 6:
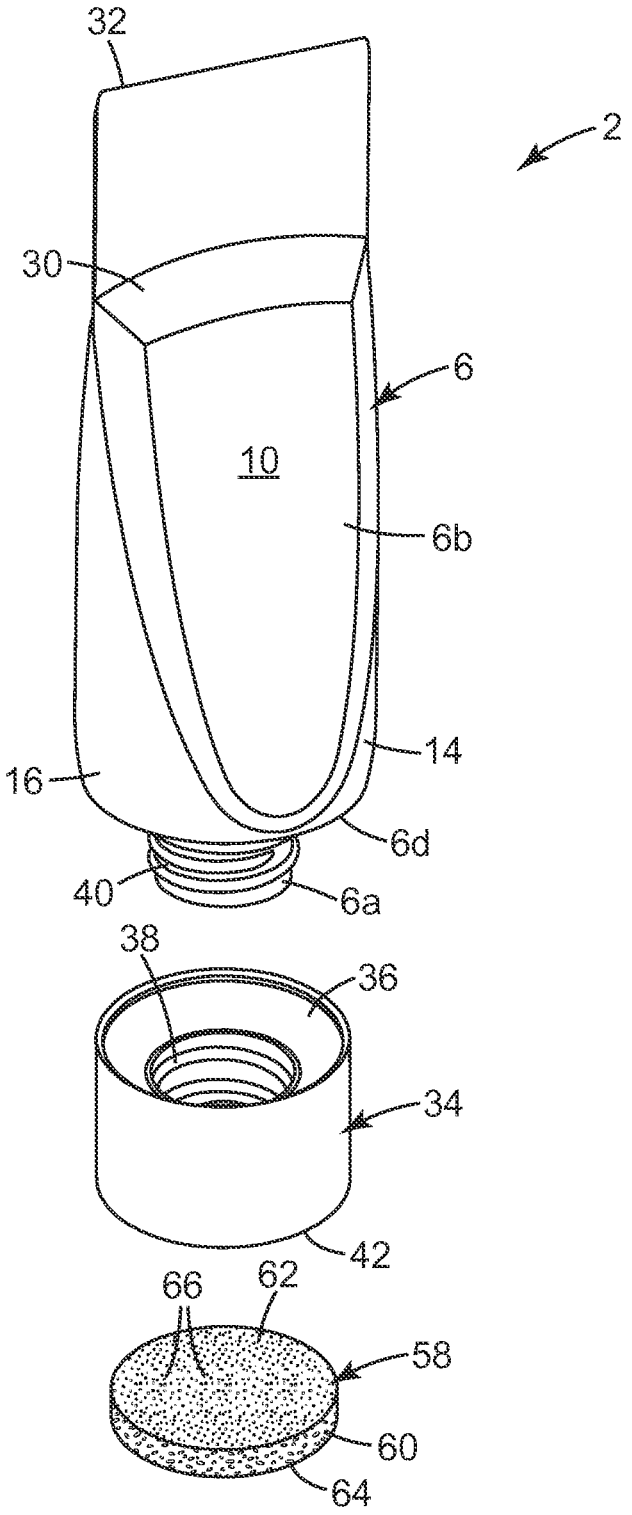
FIG. 6 is an exploded perspective view of a container according to the present disclosure.

In some embodiments, the container 2 includes an abrasive assembly 56 removably secured to the cap member 34. In some embodiments, the abrasive assembly includes a top or lid 46 and an abrasive element 58 secured to the lid 46. In some embodiments (e.g., one of which is shown in FIG. 6), abrasive element 58 is adjacent to cap member 34 and no lid is present. The abrasive element 58 may be a coated abrasive, such as sandpaper or a foam backed abrasive, including abrasive particles 66, or abrasive particles may be provided directly on the lid 46. In some embodiments, the abrasive element 58 is a foam backed abrasive including a foam substrate 60 having first and second opposed major surfaces 62, 64. The first major surface 62 is adhesive for bonding the abrasive element 58 to the lid 46, and the second major surface 64 is provided with abrading material. The abrading material may be any conventional abrading material such as garnet, aluminum oxide or silicon carbide, which may have a grit size ranging from, for example, 80 to 600.

In the illustrated embodiment, the lid 46 includes a base wall 46*a* having opposed first 48 and second 50 major surfaces, a first annular side wall 46*b* extending in a first direction away from the base wall first major surface 48, thereby defining a first cavity 52, and a second annular side wall 46*c* extending in a second direction away from the base wall second major surface 50, thereby defining a second cavity 54. The first annular side wall 46*b* is configured to slidably and releasably engage with the storage compartment 44 of the cap member 34, thereby forming a friction fit. In this manner, the abrasive assembly 56 and cap member 34 may be easily and repeatably connected and disconnected, thereby allowing an end user to quickly and easily access the abrasive element, and use the abrasive element to sand the flowable material 4 to a smooth surface after it has been applied to a surface and allowed to dry and harden. It will be recognized that other separable connections, such as a threaded connection or a snap fit connection, may also be used to separably connect the abrasive assembly 56 and cap member 34.

In the illustrated embodiment, the abrasive element 58 is arranged in the first cavity 52, and the second cavity 54 includes an optional wall portion 46*d*. The wall 46*d* may serve as a handle, thereby allowing an end user to more easily sand in tight spaces, such as along adjoining walls that meet at a 90 degree angle.

With the foregoing understanding in mind, a method of using the container 2 to repair a damaged surface will be described. First, the container 2 is opened by removing the cap member 34 along with any moisture seal that may be covering the opening 8. The mid portion 6*b* of the body member 6 is then manually squeezed by the user to dispense the desired amount of flowable material 4 from the container 2 directly onto the damaged surface. The cap member 34 is then re-secured to the container 2, and the user can use the tail portion 6*c* to spread and evenly apply the flowable material 4 to the surface. The flowable material is then allowed to dry and harden. Once the flowable material has dried and hardened, the sanding assembly 56 can be separated from the cap member 34, and the end user can use the abrasive element 58 to sand the flowable material 4 to produce a smooth finish. The smooth repaired surface can then be painted or otherwise finished in the desired manner.

Persons of ordinary skill in the art may appreciate that various changes and modifications may be made to the inventions described herein without deviating from the inventive concepts. Thus, the scope of the present disclosure should not be limited to the structures shown and described herein, but only by the language of the claims and the equivalents thereof.

What is claimed is:

1. A container for dispensing a flowable wall repair material, the container comprising:

a body member having a neck portion containing an opening for dispensing the flowable material;

a collapsible mid portion adjacent the neck portion;

a non-collapsible tail portion adjacent the mid portion capable of serving as a blade for smoothing the flowable material after the flowable material has been dispensed from the container; wherein the tail portion has a length of at least about 8 millimeters and no greater than about 60 millimeters; and an abrasive assembly adjacent to a cap member.

2. A container as defined in claim 1, further comprising a tapered shoulder portion adjacent the neck portion.

3. A container as defined in claim 1, wherein the body member is a flexible tube flattened at one end.

4. A container as defined in claim 3, wherein the unflattened portion of the tube includes tapered side walls that form a portion of the mid portion, and the flattened end forms the tail portion of the body member.

5. A container as defined in claim 1, wherein the mid portion and tail portion have a unitary one-piece construction.

6. A container as defined in claim 1, wherein the mid portion is an elongated hollow tube having a wall defining a chamber for receiving the flowable material.

7. A container as defined in claim 6, wherein the tail portion is generally flat and extends from the mid portion.

8. A container as defined in claim 7, wherein the tail is formed by opposed portions of the wall brought into contact.

9. A container as defined in claim 8, wherein the body member is formed of at least one of high density polyethylene and low density polyethylene.

10. A container as defined in claim 1, wherein the wall has a thickness of at least about 0.2 millimeters, and a thickness of no greater than about 5 millimeters.

11. A container as defined in claim 1, wherein the tail portion has a terminal end, and the terminal end tapers to a point.

12. A container as defined in claim 1, wherein the tail portion includes reinforcing rib structures.

13. A container as defined in claim 1, wherein the tail portion includes generally planar opposed major surfaces.

14. A container as defined in claim 13, wherein the tail portion opposed major surfaces include elongated recessed regions.

15. A container as defined in claim 1, wherein the tail portion is formed by laminating the wall to itself.

16. A container as defined in claim 1, wherein the mid portion and the tail portion form a boundary that is arcuate.

17. A container as defined in claim 1, wherein the tail portion includes a linear terminal edge that forms an edge for smoothing the flowable material after it has been dispensed from the container.

18. A container as defined in claim 1, wherein the cap member is configured to removably connect with the neck portion and thereby selectively close the opening in the neck portion.

19. A container as defined in claim 18, wherein the cap member includes a first end containing a threaded connection for threadably securing the cap member to the neck portion.

20. A container as defined in claim 19, wherein the cap member includes a second end containing a recessed storage compartment.

21. A container as defined in claim 1, wherein the abrasive assembly is removably secured to the cap member.

22. A container as defined in claim 1, wherein the abrasive assembly includes a lid and an abrasive element connected with the lid.

23. A container as defined in claim 22, wherein the lid includes a base wall having opposed first and second major surfaces, and further wherein the abrasive element is provided on the first major surface, and further wherein the lid includes a handle portion arranged opposite the abrasive element.

24. A container as defined in claim 23, wherein the lid includes a first annular side wall extending in a first direction away from the base wall first major surface, thereby defining a first cavity, and the lid includes a second annular side wall extending in a second direction away from the base wall second major surface, thereby defining a second cavity.

25. A container as defined in claim 24, wherein the abrasive element is arranged in the first cavity.

26. A container as defined in claim 25, wherein the first annular side wall is configured to slidably releasably engage with a mating cavity provided in the cap member.

27. A container as defined in claim 26, wherein the abrasive element is arranged in the first cavity.

28. A container as defined in claim 27, wherein the abrasive element includes a foam substrate having first and second opposed major surfaces, and further wherein the first major surface is adhesive for bonding the abrasive element to the lid, and wherein the second major surface is abrasive.

29. A container as defined in claim 1, wherein the flowable material has a putty-like consistency.

30. A container as defined in claim 29, wherein the opening is circular and has a diameter of at least about 1 millimeters and no greater than about 4 millimeters.

* * * * *